United States Patent [19]

Martorana

[11] 4,437,510

[45] Mar. 20, 1984

[54] HEAT PIPE CONTROL APPARATUS

[75] Inventor: Richard T. Martorana, Reading, Mass.

[73] Assignee: The United States of America as represented by the Secretary of the Navy, Washington, D.C.

[21] Appl. No.: 363,168

[22] Filed: Mar. 29, 1982

[51] Int. Cl.[3] ..... F28D 15/00; F28F 13/08

[52] U.S. Cl. ..... 165/32; 165/76; 165/104.26

[58] Field of Search ..... 165/32, 104.26, 96

[56] References Cited

U.S. PATENT DOCUMENTS

| | | | |
|---|---|---|---|
| 3,402,761 | 9/1968 | Swet | 165/32 |
| 3,414,050 | 12/1968 | Anand | 165/32 |
| 3,489,203 | 1/1970 | Fischell | 165/32 |
| 3,602,429 | 8/1971 | Levedahl et al. | 237/9 |
| 3,789,920 | 2/1974 | Low | 165/104.26 |
| 3,818,980 | 6/1974 | Moore, Jr. | 165/32 |
| 4,008,579 | 2/1977 | Horvay | 62/183 |

OTHER PUBLICATIONS

J. E. Eninger, *Heat Pipe Blocks Return Flow,* NASA Tech. Briefs, Spring, 1981.

*Primary Examiner*—Albert W. Davis, Jr.
*Attorney, Agent, or Firm*—Robert F. Beers; Paul S. Collignon

[57] ABSTRACT

A heat pipe is provided for transferring heat from a heat source to a heat sink. A check valve, which is operated by very low pressure, is placed in the vapor channel of a heat pipe and allows vapor to flow in a forward direction from the heat source to the heat sink. In the event that the heat sink becomes hotter than the heat source, vapor flow will reverse direction but will be blocked by the check valve.

1 Claim, 2 Drawing Figures

HEAT PIPE CONTROL APPARATUS

BACKGROUND OF THE INVENTION

The present invention relates to heat pipes and, more particularly, to a control apparatus for heat pipes to allow heat flow from a piece or assembly to a sink and to prevent heat flow from a sink back to the piece or assembly.

Heat pipes operate to transfer heat from a relatively high temperature environment, such as would ordinarily be found within an electronic housing to a relatively low temperature area, such as would be present outside the housing. Transfer of heat in a heat pipe is effected by movement of vapor, produced by heating liquid in the inner portion of the pipe which is contained in the housing into the outer portion of said pipe which is positioned exteriorly of said housing, for radiation thereby. The outer portion of the heat pipe, being cooler, will condense the vapor and return it, as liquid, to the inner portions by capillary action, as by a wick, for revaporization and repetition of the cycle. If it is desired to "control" the heat pipe, such control may be effected either by varying the vapor flow through the pipe or by varying the flow of liquid through the wick, or both.

Various devices have been employed to control flow in heat pipes. One device which has been used is a pump to move cooling fluid to a heat sink with subsequent shutting down of the pump when isolation is desired. The disadvantage of using pumps, however, is that power is required and also additional weight is added. Particularly in an aircraft, both power and weight are critical items.

In U.S. Pat. No. 3,414,050, entitled, "Heat Pipe Control Apparatus", which issued Dec. 3, 1968, to Davinder K. Anand, a disk type damper valve is provided for controlling vapor flow. A wick is provided in the heat pipe and a movable wick segment is used to control liquid flow. The damper valve includes a fixed disk having spaced apertures and a movable disk pivotally connected to the fixed disk. A bellows which is operated by gas pressure from a tank is used to rotate the movable disk relative to the fixed disk.

Another mechanically operated valve for a heat pipe is shown and described in U.S. Pat. No. 3,489,203, entitled, "Controlled Heat Pipe", which issued Jan. 13, 1970, to Robert E. Fischell. In this patent, one embodiment is shown having a butterfly valve in the pipe and a bimetallic spring thermostat is used for actuating the butterfly valve thereby controlling the flow of vapor in the heat pipe.

SUMMARY OF THE INVENTION

A heat pipe is provided for removing heat from a heat source, such as an electronic assembly, to a heat sink, but preventing or minimizing flow from a heat sink back to the heat source when the heat source is at a temperature lower than the temperature of the heat sink.

A check valve which is operated by very low pressure is placed in the vapor channel of a heat pipe and allows vapor flow in a forward direction but blocks vapor flow in a reverse direction thereby rendering the heat pipe a high resistance conductor. If the heat sink becomes hotter than the heat source, vapor flow reverses but is blocked by the closure of the check valve. The walls of the heat pipe are made of low conductivity metal so that heat can only be conducted inefficiently through the walls of the pipe.

It is therefore a general object of the present invention to provide a heat pipe which transfers heat with a low temperature difference in a forward direction, but a high temperature difference in the opposite direction.

Other objects, advantages and novel features of the present invention will become apparent from the following detailed description of the invention when considered in conjunction with the accompanying drawing.

DESCRIPTION OF THE PREFERRED EMBODIMENT

Figure 1:
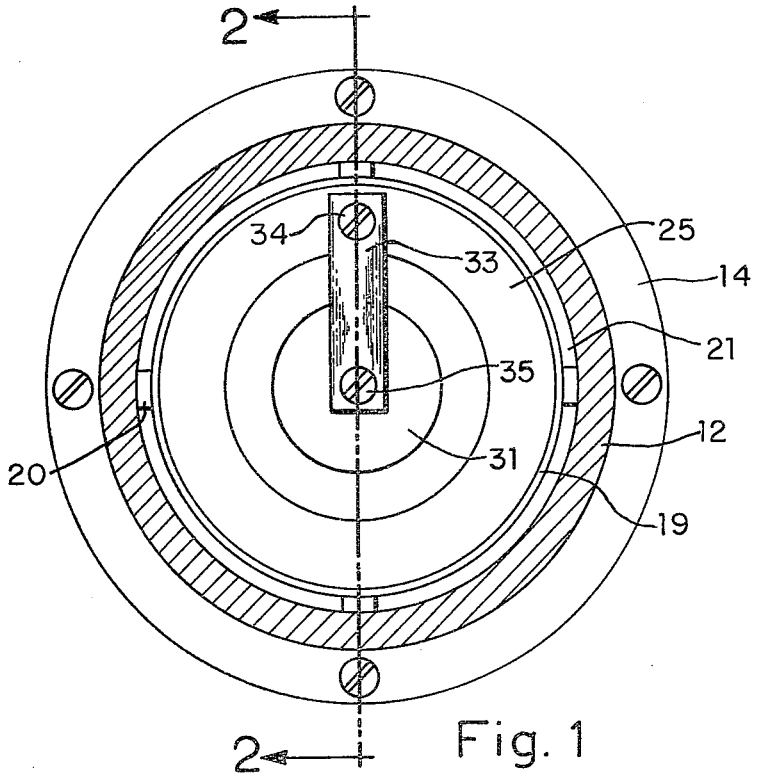
FIG. 1 is an end view, with end cap removed, of a preferred embodiment of the invention.
Figure 2:
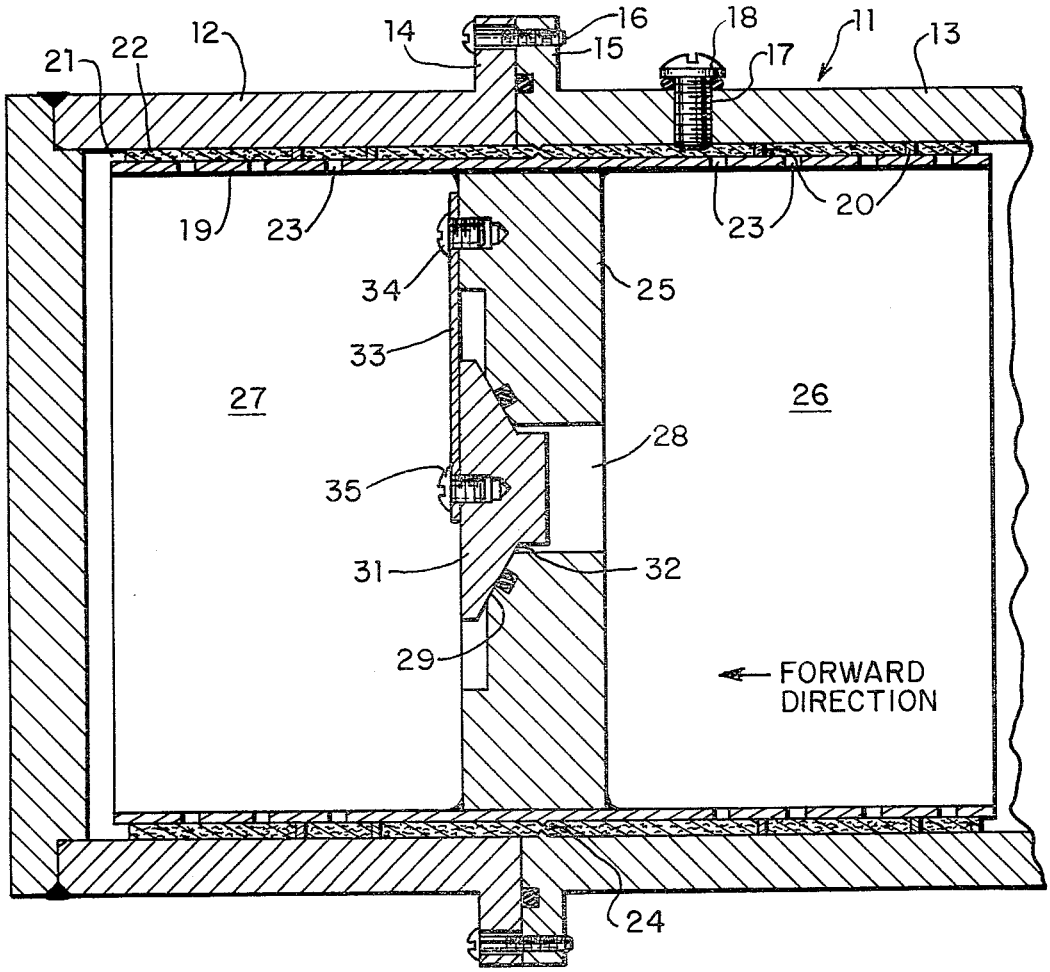
FIG. 2 is a partial sectional view taken on line 2—2 of FIG. 1.

Thermal designers regularly work with electrical analogs. The components that presently exist are resistors (conductors), capacitors (masses), grounds (heat sinks), batteries (fixed temperatures), current sources (heaters), short circuits (heat pipes) and open circuits (insulators). The present invention adds a new component and functions as a diode.

Referring now to the drawing, a heat pipe is shown having an outer casing 11 which is comprised of a forward half 12 and a rear half 13. Forward half 12 has a flange 14 thereon and, likewise, rear half 13 has a flange 15 thereon and flanges 14 and 15 are attached together by a plurality of bolts 16. By way of example, rear half 13 of casing 11 might extend into a housing, such as a housing for an electronic assembly, and forward half 12 would be outside the housing in ambient air which normally is cooler than the air inside the electronic housing when the electronic devices inside the housing are operated. A port 17, which is shown closed by plug 18, is provided in rear half 13 for adding fluid to the heat pipe.

A metallic cylinder 19 is concentrically mounted within outer casing 11 and serves as a vapor channel for the heat pipe. Cylinder 19 is supported by a plurality of spacers 20 positioned between the inner periphery of casing 11 and the outer periphery of cylinder 19. A narrow cylindrical wicking gap 21 is provided between the outer periphery of cylinder 19 and the inner periphery of casing 11 and a wick 22 is positioned in gap 21. A plurality of holes 23 are provided in cylinder 19 and serve as condensation/evaporation pores. A capillary constriction seal 24 is positioned approximately midway between the ends of cylinder 19.

A separator 25 is positioned inside cylinder 19 approximately midway between the ends of cylinder 19 and provides an evaporator section 26 and a condensation section 27. A centrally located aperture 28 is provided in separator 25, and aperture 28 is provided with a tapered surface 29 which serves as a valve seat. A stopper 31, which has a complimentary tapered surface 32 engageable with tapered surface 29, is pivotally attached to separator by a leaf spring 33. As shown in the drawing, one end of leaf spring 33 is attached by screw 34 to separator 25 and another end of leaf spring 33 is attached by screw 35 to stopper 31.

OPERATION

In operation, by way of example, the rear half 13 of the embodiment shown in the drawing might extend into a housing of an electronic component assembly, and the forward half 12 might be outside the housing in cooler air. Heat from electronic components inside a housing will cause liquid in evaporator section 26 to vaporize and vapor will flow through aperture 28, and the force provided by the vapor flow will cause stopper 31 to pivot thereby letting the vapor pass through aperture 28 into condensation section 27. As condensation section 27 is at a cooler temperature, the vapor will condense and be absorbed by wick 22 and carried back to condensation section 27 where the liquid will again be vaporized.

In the event that section 26 becomes cooler than section 27, vapor inside section 27 will tend to flow in a reverse direction but will be prevented by stopper 31 which serves as a one-way valve.

It can thus be seen that the present invention allows vapor flow in a forward direction, but blocks vapor flow in a reverse direction thereby rendering the heat pipe a high resistance conductor (insulator). When the heat sink temperature is lower than the heat source which is being cooled, heat is moved forward like a heat pipe and stopper 31 can be opened. In the event that the heat sink becomes hotter than the heat source so that the heat source is no longer being cooled, vapor flow will tend to reverse but will be blocked. Heat can only be conducted inefficiently through the walls of the pipe and, by making the walls of low conductivity metal, this effect can be minimized.

I claim:

1. A heat pipe contro apparatus comprising:

an outer casing, an inner casing inside of and spaced apart from said outer casing, wick means positioned between said inner and outer casings, a plurality of holes in the periphery of said inner casing, a separator in said inner casing dividing said inner casing into a heat input section and heat sink section, an aperture in said separator, a heat source, a condensable fluid in said heat pipe and movable upon vaporization by said heat source from said heat input section through said aperture to said heat sink section wherein said fluid is condensed and absorbed by said wick means, closure means for preventing vapor flow from said heat sink section through said aperture to said heat input section, said closure means comprising a stopper attached by a leaf spring to the side of said wall within said heat sink section whereby vapor flow from said heat input section through said aperture moves said stopper to open said aperture, and said outer casing and said inner casing having means defining a capillary restriction seal in the space therebetween, said capillary restriction seal being located approximately midway between the ends of said inner casing.

* * * * *